US007487896B2

(12) United States Patent
Howard, Jr. et al.

(10) Patent No.: US 7,487,896 B2
(45) Date of Patent: Feb. 10, 2009

(54) PROTECTIVE SLEEVE FOR PORTABLE COMPUTER

(75) Inventors: William E. Howard, Jr., Fort Thomas, KY (US); Aaron I. Kaffen, Cincinnati, OH (US)

(73) Assignee: InfoCase, Inc., Cincinnati, OH (US)

( * ) Notice: Subject to any disclaimer, the term of this patent is extended or adjusted under 35 U.S.C. 154(b) by 540 days.

(21) Appl. No.: 10/917,032

(22) Filed: Aug. 12, 2004

(65) Prior Publication Data

US 2006/0032882 A1 Feb. 16, 2006

(51) Int. Cl.
*A45C 15/00* (2006.01)

(52) U.S. Cl. ..... 224/576; 224/926; 190/110

(58) Field of Classification Search ..... 224/576, 224/929, 930, 236–239, 240; 383/78, 84; 190/110

See application file for complete search history.

(56) References Cited

U.S. PATENT DOCUMENTS

| | | | | | |
|---|---|---|---|---|---|
| 1,747,454 | A * | 2/1930 | Mees | 224/243 |
| 4,703,161 | A * | 10/1987 | McLean | 235/1 D |
| 5,002,184 | A * | 3/1991 | Lloyd | 206/305 |
| 5,105,338 | A | 4/1992 | Held | 361/391 |
| 5,217,119 | A | 6/1993 | Hollingsworth | 206/583 |
| 5,285,833 | A * | 2/1994 | Haxby | 150/102 |
| 5,316,141 | A * | 5/1994 | Jalomo | 206/320 |
| 5,392,975 | A * | 2/1995 | Blankenship, Jr. | 224/148.5 |
| 5,524,754 | A * | 6/1996 | Hollingsworth | 206/320 |
| 5,678,666 | A * | 10/1997 | Shyr et al. | 190/102 |
| 5,762,170 | A | 6/1998 | Shyr et al. | 190/109 |
| 5,826,770 | A | 10/1998 | Chuang | 224/607 |
| 5,857,600 | A * | 1/1999 | Akutsu | 224/240 |
| 5,971,148 | A | 10/1999 | Jackson | 206/320 |
| 6,109,434 | A * | 8/2000 | Howard, Jr. | 206/320 |
| D461,308 | S * | 8/2002 | Snider | D3/228 |
| 6,612,432 | B2 * | 9/2003 | Motson | 206/305 |
| 6,655,528 | B2 | 12/2003 | King | 206/320 |
| 2002/0003155 | A1 * | 1/2002 | Holland et al. | 224/242 |
| 2003/0132127 | A1 | 7/2003 | Miller et al. | 206/320 |
| 2003/0162001 | A1 * | 8/2003 | Rosch et al. | 428/192 |
| 2003/0217940 | A1 | 11/2003 | Russell et al. | 206/320 |
| 2004/0108625 | A1 * | 6/2004 | Moder et al. | 264/510 |
| 2005/0162824 | A1 * | 7/2005 | Thompson | 361/686 |
| 2005/0189188 | A1 * | 9/2005 | Barnes | 190/110 |

* cited by examiner

*Primary Examiner*—Nathan J Newhouse
*Assistant Examiner*—Jack Morgan, Jr.

(57) ABSTRACT

A protective sleeve for a portable computer, or other fragile article, is described. The protective sleeve is specifically designed to be used in conjunction with, and inside of, a larger piece of luggage, such as a suitcase or backpack.

The protective sleeve is comprised of a semi-rigid material, such as closed-cell polyethylene foam. The semi-rigid material is preferably covered by abrasion-resistant fabric.

19 Claims, 4 Drawing Sheets

16
30
20
26
14
24
32
18
12
22
10
28

PROTECTIVE SLEEVE FOR PORTABLE COMPUTER

FIELD OF THE INVENTION

The invention relates generally to protective devices for storing and transporting fragile electronic devices, such as portable computers. In particular, it relates to protective sleeves for protecting portable computers during storage and/or transport within a larger piece of luggage used for transporting and storing the computer, in addition to other items, such as books, clothing and personal articles.

BACKGROUND OF THE INVENTION

In contemporary society, portable computers are widely used in business, education, and other fields of endeavor.

By using a portable, or laptop, computer, a businessman can carry a large amount of the information needed for his business activities, all in one piece of apparatus. It is almost like carrying his office with him during his business travels. [For convenience and clarity, terminology in the masculine gender is employed herein, even though the feminine gender could be fully appropriate in many such references.] When a businessman travels by air, he typically must make a choice of items to carry into the cabin of an airplane. Air travel restrictions limit the traveler to one small suitcase and one piece of personal baggage. How and where does a traveler carry his portable computer? Most travelers are unwilling to risk loss or damage to their computers by carrying the computer in checked baggage. Similarly, most travelers are unwilling to carry their computers in their small carry-on suitcases, where such articles as an extra pair of shoes or various articles of personal grooming equipment might be pounded against the computer. The only other option is to carry his computer in a dedicated computer storage case, as the traveler's personal baggage. The latter option is effective, except that it precludes the traveler from carrying a briefcase, which might be desirable for transporting papers and documents. For a female traveler, the situation is worse, for her personal bag must serve as her purse.

There are numerous types of commercially available dedicated protective cases for portable computers. Examples of such protective cases may be seen on the shelves of computer stores, office supplies stores, and the like. A few examples of disclosures regarding protective cases may be found in the following U.S. U.S. Pat. No. 5,105,338 (Held), U.S. Pat. Nos. 5,217,119 and 5,524,754 (Hollingsworth), U.S. Pat. Nos. 5,678,666 and 5,762,170 (Shyr), U.S. Pat. No. 5,826,770 (Chuang), and U.S. Pat. No. 5,971,148 (Jackson). There are many other similar disclosures. What is common to such disclosures is that each such protective case is presumed to be what a traveler would carry onto an airplane as a piece of personal baggage. Whatever else a traveler would carry onto a plane would be placed inside such a case. The disclosures by Shyr (U.S. Pat. No. 5,762,170) and Chuang are specifically directed toward this design concept.

King (U.S. Pat. No. 6,655,528) describes a dedicated computer carrying case that protects a computer by preventing shock imposed on the carrying case from reaching the computer.

In U.S. Pat. No. 6,109,434, Howard, Jr. discloses a type of protective case specifically intended to remain in place around a portable computer while the computer is in use. In spite of the small size of this case, the disclosure of carrying straps indicates that it is intended as a piece of luggage.

Miller et al (published U.S. Patent Application Ser. No. 2003/0132127) describe an elastic sleeve that is slipped over a portable computer, so that blocks of foam material may be secured thereto. While their invention suggests the possibility of protecting a computer that is carried within another piece of luggage, it also appears to be cumbersome to use.

Students, particularly college students, often need computers to support their course of study. An engineering student may need to calculate stresses in a structural member. An art student may need to use a computer in creating a drawing. Any student may need to connect to a college-wide network to download E-mail, assignments, notes, and the like. As many students choose to carry their books, computers and the like, in a backpack or knapsack, the computer must compete with those textbooks for space in the backpack. Also, such backpacks are often victims of rough handling by their owners, and the backpack offers no means for protecting the computer against damage, in the event that the backpack crashes to the floor, or if the books should be pounded against the computer.

A lightweight protective sleeve, as described herein below, offers protection for a portable computer whenever it might be carried, along with other objects, inside a larger piece of luggage. Further, it can maintain storage space for the computer inside the larger piece of luggage while the computer is temporarily removed for use.

BRIEF DESCRIPTION OF THE INVENTION

The present invention comprises a lightweight sleeve, into which a portable computer is readily placed. The configuration of the sleeve is essentially a five-sided box, with a closure flap that may be alternately disposed in a closed position, where it serves to secure a computer within the box, or in an opened position, where it permits access to a portable computer stored within the box. The closure flap is self-adjusting, so that simply by closing that flap, the protective sleeve can accommodate portable computers of various sizes. The dimensions of the sleeve are chosen to accommodate a broad range of widely used portable computers.

Functionality of the sleeve depends upon its configuration, as might be expected, but also upon the material selected for the sleeve. Preferred materials for the sleeve are described as semi-rigid. In the context of the present invention, a semi-rigid material is less rigid than metal or hard plastic (such as polycarbonate), but more rigid that a compliant foam material, such as polyurethane foam commonly used for seat cushions. A semi-rigid material, such as closed-cell polyethylene foam, can deform to absorb energy when it is subjected to impact loading, but it tends to return to its original shape when the loading is removed. A semi-rigid material tends to retain its configuration under modest loads. Those skilled in the materials engineering arts will recognize that there is a wide range of values of rigidity for various types of engineering materials; they will also recognize that the functionality of such materials appropriate to the present invention implies a broad range of such values that lie between the extremes described above.

The sleeve optionally comprises a carrying handle or shoulder strap, so that it may be employed as a stand-alone protective case, should service in that mode be required.

For convenience, the components of the sleeve are described with the same terminology that would be used to describe the exterior surfaces of a portable computer, as oriented to permit use by an operator. The top of the computer is defined by opening the computer so that the keyboard is available for use; the top is where the keyboard is located. The front of the computer is adjacent to the space bar of the computer. The lid of the computer, which houses its viewing screen, is hinged at the back of the computer. The protective sleeve comprises top and bottom panels, front and back panels, and one side panel. The five panels are secured to each other in such a way as to create a five-sided box. The closure flap, disposed opposite the side panel, functions as a sixth side of the box.

The dimensions of a portable computer or protective sleeve may be identified as length (measured in a left-right direction, parallel to the space bar of the computer), width (measured in a front-back direction, perpendicular to the space bar) or thickness (measured in a vertical direction).

It is apparent that a portable computer may be placed within the protective sleeve of the present invention in four different relative orientations. Relative to the computer, the sleeve may be rotated 180° about a left-right axis (thereby interchanging top and bottom, and front and back of the sleeve). It may also be rotated 180° about a vertical axis (thereby interchanging left and right sides, and front and back sides of the sleeve). Except where a sleeve may be specifically configured to accommodate one particular model of portable computer, such interchanging of relative positions of computer and protective sleeve is inconsequential. Many right-handed users find that orienting the protective sleeve as shown in the accompanying drawings is very convenient, particularly with respect to disposing the computer within the sleeve.

DETAILED DESCRIPTION OF THE INVENTION

The functionality and design features of the protective sleeve are conveniently described with reference to the appended drawings. Note that the same reference number is used to identify a particular design feature in the text, and in any of the drawings. Also, the computer and protective sleeve are shown in the same orientation in each of the drawings.

Figure 1:
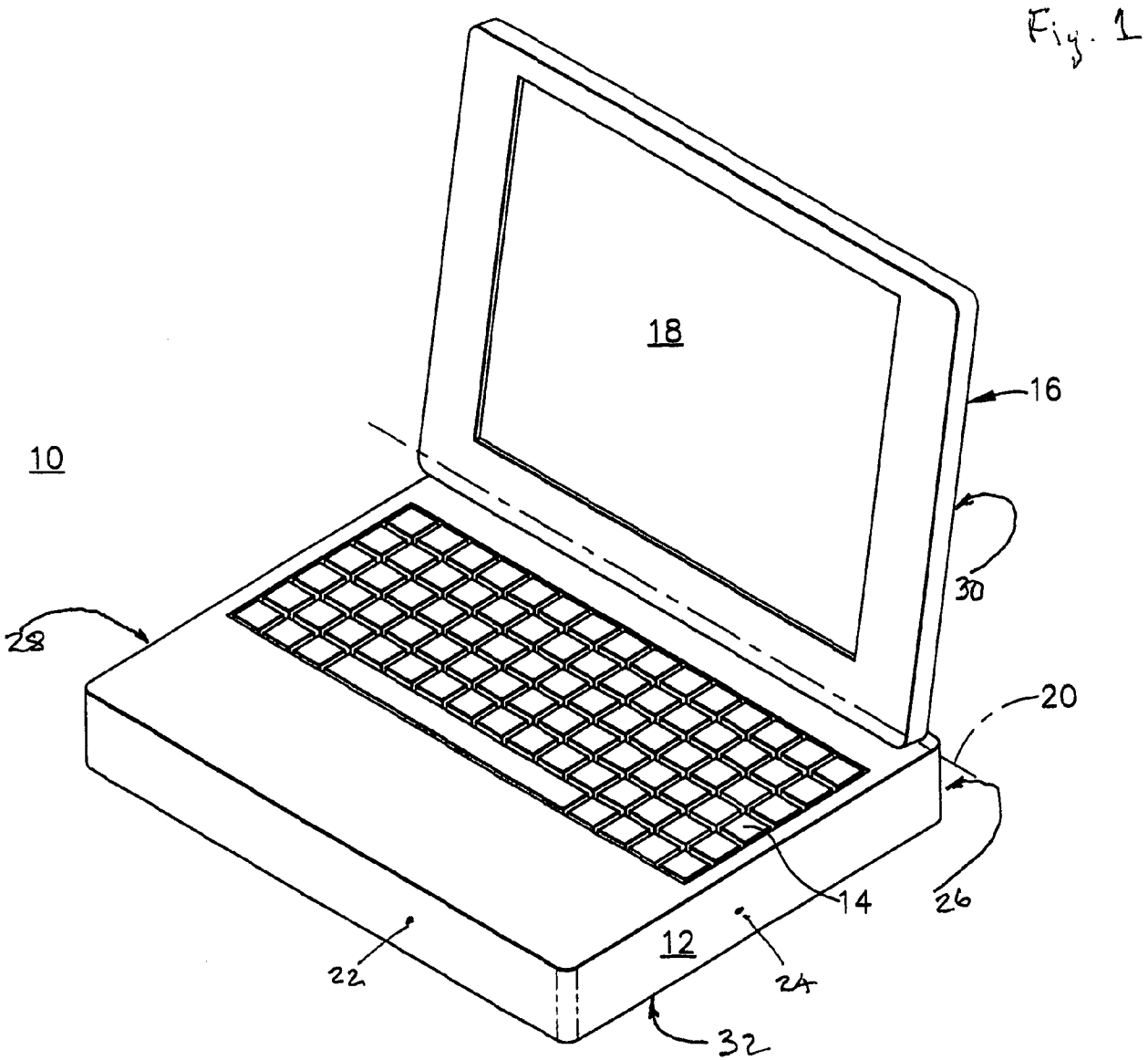
FIG. 1 illustrates a representative portable computer, disposed in an opened position, and ready for use.

A representative portable computer is shown schematically in FIG. 1. The computer 10 comprises a case 12, within which is a keyboard 14. A lid 16, within which is a viewing screen 18, is joined to be computer by hinge means having a hinge axis shown at 20. A computer comprises many fragile components disposed within the case (not shown in the drawing); however, the viewing screen 18 is particularly fragile. The front side of the computer is shown at 22 and the right side is shown at 24. The rear side, left side, top and bottom are not visible in FIG. 1. Locations of these features of the computer are indicated by arrows 26, 28, 30 and 32, respectively.

Figure 2:
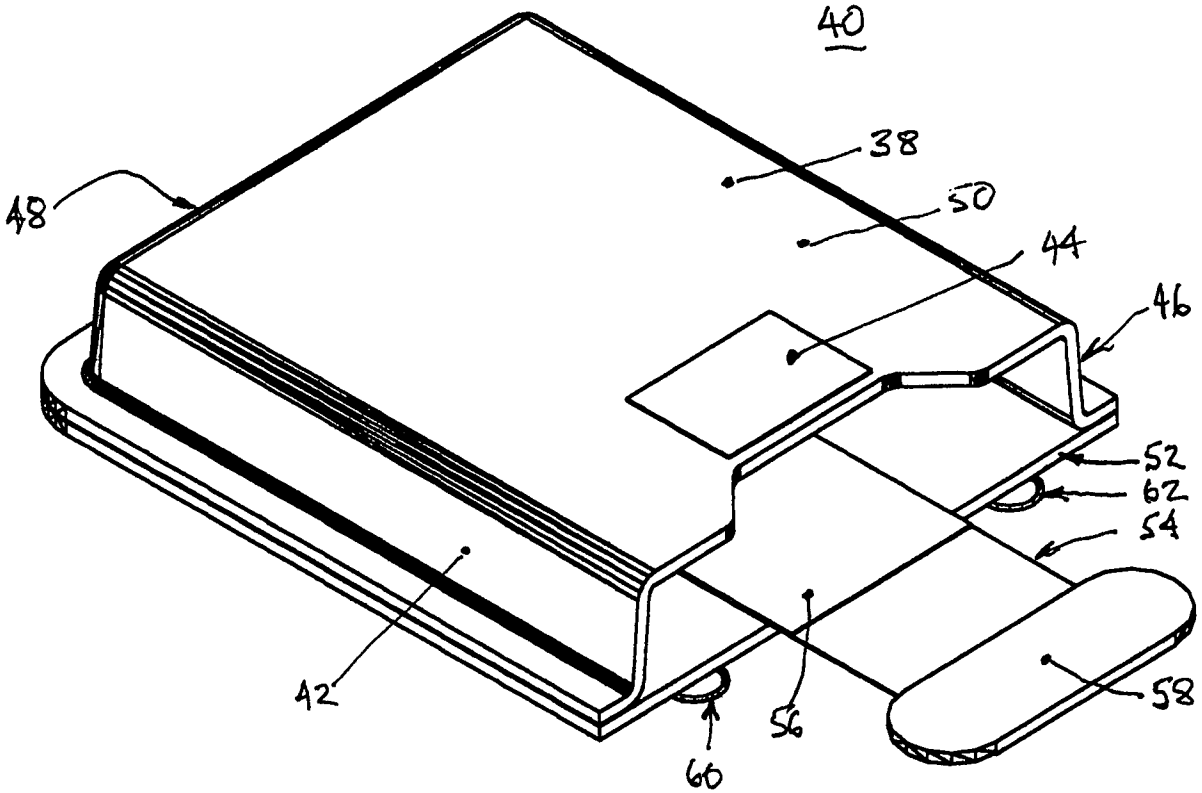
FIG. 2 illustrates the protective sleeve of the present invention.

FIG. 2 represents, in schematic form, the protective sleeve of the present invention. The protective sleeve is shown generally at 40. It is comprised of two principal components, a bottom panel, shown at 52, and a top shell, shown at 38. The bottom panel 52 is provided with a closure flap 54, secured to the inside surface of the bottom panel, and a plurality of D-rings, shown at 60 and 62, secured to the outside surface of the bottom panel. The closure flap 54 is provided with a layer of anti-slip material 56 on part of the inside surface thereof The closure flap is also provided with a piece of hook-and-loop material at the end thereof, shown at 58. Hook-and-loop material may be identified by the trade name for one such product—Velcro.

The top shell 38 is conveniently produced as a single molded article, though it functionally comprises a front panel 42, a side panel 48, a rear panel 46 and a top panel 50. The top shell is provided with a patch of hook-and-loop material, shown at 44, on the outside surface thereof. The hook-and-loop material shown at 44 is preferably hook-type material, and that at 58 is preferably loop-type material. The essential functionality of these two pieces of hook-and-loop material is that one mates with the other, thereby securing the closure flap 54 to the top shell 38; when thus secured to the top shell, the closure flap effectively secures a portable computer within the protective sleeve. The configuration just described permits use of the protective sleeve with portable computers having a range of overall dimensions.

Each of the panels is generally rectangular in shape, having four edges; an edge of one panel is joined to the corresponding edge of the adjacent panel. The panels and other components of the protective sleeve may fabricated as an integral assembly of two or more panels, or they may be joined to one another by any convenient method, such as sewing, adhesive joining, riveting, or by any equivalent method. Sewing is deemed a particularly effective method, and toward that end, the bottom panel 52 and top shell 38 are provided with flanges that can be readily sewn together. Similarly, the closure flap 54 is preferably sewn to the inside surface of the bottom panel, and the mating patches of hook-and-loop material (shown at 44 and 58) are preferably sewn to their respective underlying members (shown at 50 and 54).

Figure 3:
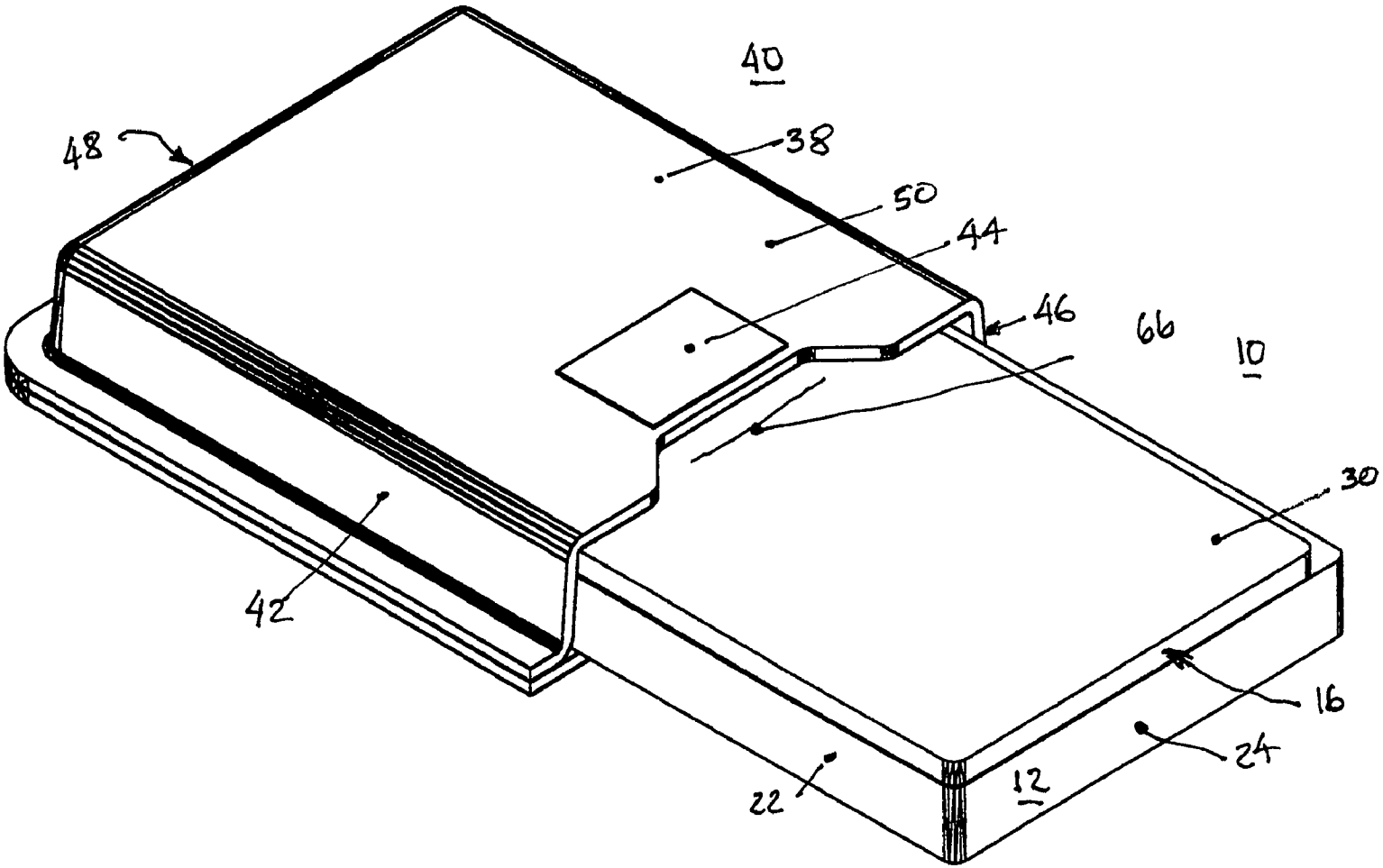
FIG. 3 illustrates a protective sleeve of the present invention and a representative portable computer (shown in a closed position) disposed partially within the protective sleeve.

In FIG. 3, a portable computer 10 is shown in its closed configuration. The computer has been partially inserted into the protective sleeve 40. The computer is fully inserted into the protective sleeve when the left side of the computer 28 comes into contact with the interior surface of the left side of the sleeve 48. The computer is then secured by raising the closure flap (shown at 54 in FIG. 2) until the top of the computer 30 comes into contact with the interior surface of the top of the protective sleeve 50, and then swinging the closure flap toward the left side of the sleeve, and securing the mating pieces of hook-and-loop material to each other. Note that movement of the portable computer within the protective sleeve in reduced, specifically because the closure flap, when installed as noted above and secured to the top of the sleeve, holds the computer against the top and against the left side of the sleeve. This functionality of the closure flap is possible because of the location of attachment of the closure flap to the bottom of the sleeve, the presence of a notch in the right edge of the top of the sleeve, and the means for securing the end of the closure flap to the top of the sleeve. These features of the present invention are discussed in greater detail hereinbelow.

A piece of anti-slip material (such as rubber or neoprene), shown at 56, is secured to the closure flap. It reduces the likelihood that a computer might slide within the protective sleeve, particularly in the front-to-back direction.

Dimensions of the protective sleeve depend upon the exterior dimensions of the portable computer with which it is used. Because keyboards used with portable computers are generally of the same size and configuration, many different models of such computers have very similar dimensions. Thus, it is feasible to accommodate a substantial number of the various types of portable computers with a small number of different protective sleeves.

Physical dimensions of the protective sleeve may vary considerably without adversely affecting the functionality thereof. For example, the thickness of the material of the top shell 38 and bottom panel 52 must be great enough to provide adequate protection for the portable computer, but small enough so that the protective sleeve is reasonably compact. A thickness of approximately 0.25 inch is deemed preferable. However, any thickness from about 0.06 inch to about 0.5 inch would be usable. Similarly, the flange incorporated into the top shell 38 must be wide enough to facilitate joining the top shell and bottom panel 52 together, and narrow enough to minimize the overall size of the protective sleeve. Any dimension between about 0.12 inch and 1.0 inch would suffice for a protective sleeve that is sewn together. The flange also contributes to the physical protection afforded by the sleeve to the computer, to the extent that it cushions the computer against impact damage when dropped on an edge or corner. A flange width of about ⅜ inch is deemed preferable.

The closure flap serves two functions: securing the computer within the protective sleeve and covering the right side of the computer. These functions are reasonably met if the width of the closure flap is at least 25% of the overall width of the protective sleeve.

In a preferred embodiment of the protective sleeve, the length of the protective sleeve is such that the right side of the sleeve overhangs the computer by about 0.5 inch. Any dimension up to about 1.0 inch would be suitable. A notch in the top panel of the protective sleeve (shown at 66 in FIG. 3) provides for securing the computer within the protective sleeve, while still providing the protection afforded by the overhanging lip around the right side of the sleeve. Obviously, the front-to-back width of the notch must be great enough to accommodate the width of the closure flap 54. The competing functionalities of the lip around the case and the closure flap are reasonably met if the width of the closure flap is between about 25% and 75% of the overall width of the protective sleeve. Similarly, the left-to-right length of the notch must allow for adjusting the closure flap to secure computers of various sizes.

Another variable in designing and constructing the protective sleeve of the present invention is the location where the closure flap 54 is attached to the bottom panel 52. That location could be at the extreme left end of the bottom panel; the closure flap could be sewn into the joint between the top shell and the bottom panel. That location, however, implies a waste of the material used for the closure flap. The need for the closure flap to secure a relatively thin computer against the top panel of the protective sleeve dictates that the closure flap cannot be attached at the right edge of the bottom panel. Thus, the preferred location of attachment should lie somewhere within the protective sleeve, perhaps 20%, as a minimum, of the distance from the right edge of the base panel to the left edge. Approximately 30% of that distance is deemed the most preferred location.

Those persons who are familiar with the design and manufacture of protective cases for computers will recognize that the dimensions cited herein may be varied considerably without affecting the functionality of the protective sleeve of the present invention. Thus, the dimensions cited herein should be regarded as exemplary of, rather than limiting upon, the present invention.

The choice of materials to be used in fabricating the protective sleeve of the present invention is dictated by the functionality thereof. As noted hereinabove, the material is selected from a broad class of semi-rigid materials. The functional requirement of the panels of the protective sleeve is that the material must be compliant enough to cushion the computer against damage that might occur if the computer were dropped onto a hard surface, yet rigid enough to maintain the overall shape of the protective sleeve. As noted hereinabove, a closed-cell polyethylene foam material reasonably meets both functional requirements. The performance of the panels may be enhanced by attaching abrasion-resistant fabric to both surfaces of the foam panels. Abrasion-resistant fabric, such as a knit polyester fabric, a woven nylon fabric, or the like, enhances the resistance of the semi-rigid foam material to abrasion and/or cutting. Further, it enhances the esthetic appearance and carrying comfort of the protective sleeve. Three-ply materials, comprising a semi-rigid foam core sandwiched between two layers of fabric, are widely used in the manufacture of computer cases and other forms of luggage.

The closure flap 54 comprises at least one layer of fabric, so that it is sufficiently flexible for easy positioning to secure the portable computer within the protective sleeve.

Should a user of the protective sleeve choose to do so, he could attach a handle or shoulder strap to the D-rings shown at 60 and 62. Such devices, preferably provided with snap shackles or spring clips for removable attachment to the D-rings, expand the utility of the protective sleeve to include stand-alone protection for a portable computer. The D-rings may be conveniently attached to the protective sleeve by loops of web belting that are sewn to the bottom panel 52.

Figure 4:
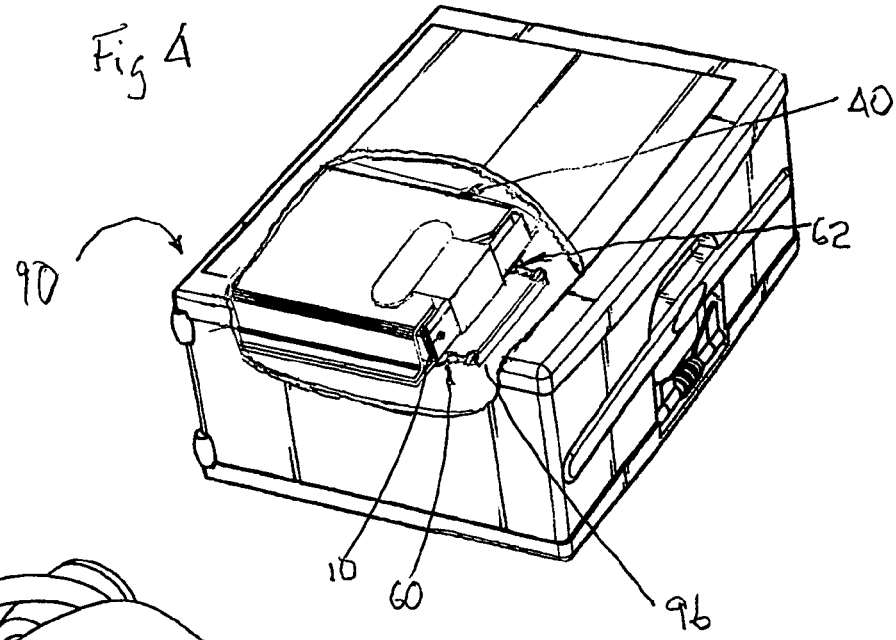
FIG. 4 represents a partial sectional view of a suitcase showing the protective sleeve of the present invention disposed therein. A handle, attached to the protective sleeve, is also shown.
Figure 5:
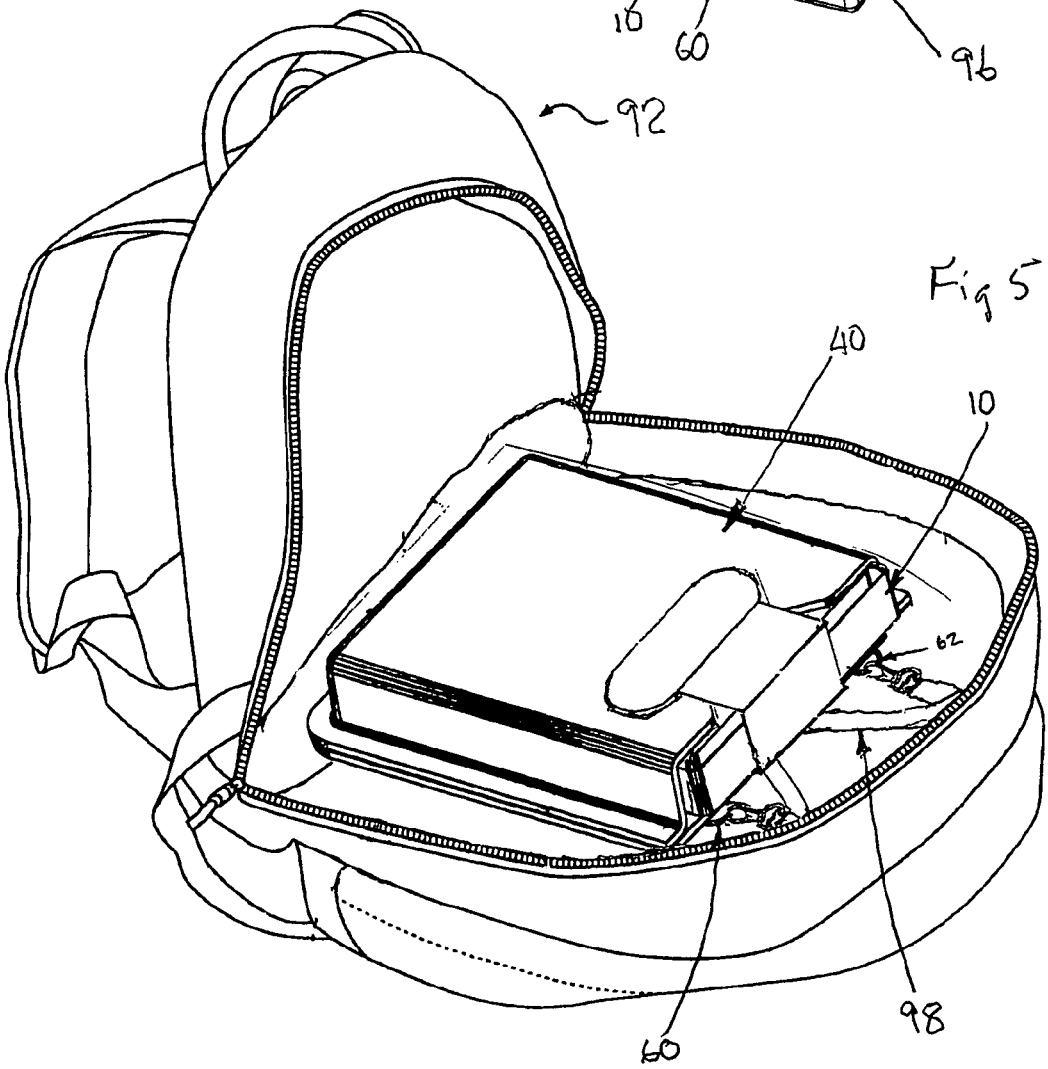
FIG. 5 represents a view of an unzipped backpack showing the protective sleeve of the present invention disposed therein. A carrying strap, attached to the protective sleeve, is also shown.

The use of a handle 96 attached to D-rings 60 and 62 is shown in FIG. 4. The use of a carrying strap 98 attached to D-rings 60 and 62 is shown in FIG. 5. Note that FIGS. 4 and 5 also illustrate the disposition of the portable computer 10 entirely within the protective sleeve 40.

The protective sleeve may be fabricated by joining the edges of the five panels of which it is constructed, such as by sewing. In this mode of construction, the top and bottom panels, front and back panels, and one side panel are sewn to each other to create a five-sided box. This method of construction is simple and inexpensive.

However, the resistance of the protective sleeve to crushing may be improved by incorporating the top panel, the front and back panels and one side panel into a single component, identified herein as the top shell. This configuration is illustrated in FIGS. 2 and 3; it is deemed a preferred mode of the invention. This configuration may be achieved by reconfiguring a flat panel of semi-rigid material into a molded shell, employing a process such as thermoforming. In such an operation, the flat panel would be softened by heating, then squeezed between mating dies to achieve the desired configuration, and cooled therebetween. The fabric employed in such panels is generally compliant enough so that its shape conforms to that of the reshaped foam without wrinkling the fabric.

It should be noted that modifying the shape of the panels may include changing the thickness thereof, to provide recesses for the D-rings and the patches of hook-and-loop material. Such recesses serve to streamline the outside contours of the protective sleeve.

The protective sleeve of the present invention is particularly useful when used in conjunction with a larger piece of luggage, such as a suitcase, a backpack, or the like. As described hereinabove, owners of portable computers frequently find it appropriate to carry or store their computers within a larger container, which is often to carry other items, such as books, clothing, or various personal articles. In the absence of a protective device, such as the protective sleeve of the present invention, those items may damage the portable computer. The nature of the larger piece of luggage, and the specific design features thereof, are inconsequential to the present discussion; the protective sleeve of the present invention is reasonably functional in conjunction with any such piece of luggage that is large enough to enclose it. The combination of a portable computer secured within a protective sleeve is deemed to be an integral part of the present invention. Likewise, disposing that combination within a larger piece of luggage is also deemed to be an integral part of the present invention.

The use of the protective sleeve of the present invention in conjunction with a larger piece of luggage is illustrated in FIGS. 4 and 5. FIG. 4 illustrates the disposition of the combination of a portable computer 10 disposed entirely within the protective sleeve of the present invention 40 within a suitcase 90. FIG. 5 illustrates the disposition of the same combination within a backpack 92.

Numerous modifications to the present invention, some of which may be made either to facilitate manufacture, or to accommodate additional design features, will be apparent to those skilled in the applicable arts. Such modifications are deemed to be comprehended by the descriptions and drawings of the present application and the claims appended hereto.

We claim:

1. A protective sleeve for a portable computer, comprising:

a top panel, a bottom panel, a front panel, a back panel and a side panel, wherein each panel is rectangular in shape and comprises inside and outside surfaces and four edges around its periphery, and wherein the panels are permanently joined to each other, correspondingly edge to edge, to create a five-sided box that has an open side thereof, thereby providing access to an internal volume within the box;

a closure flap characterized by inside and outside surfaces and first and second ends, wherein the outside surface at the first end of the closure flap is permanently secured to the inside surface of the bottom panel at a location within the box, and wherein the closure flap extends through the open side of the box; and securing means for separably securing the inside surface proximate to the second end of the closure flap to the outside surface of the top panel;

wherein at least one of said panels comprises a semi-rigid material, and additionally comprises abrasion-resistant fabric attached to substantially all of both inside and outside surfaces thereof; and wherein the internal volume comprises such size and shape to accommodate the portable computer therein.

2. The protective sleeve for a portable computer, as recited in claim 1, wherein the semi-rigid material comprises closed-cell polyethylene foam.

3. The protective sleeve for a portable computer, as recited in claim 1, wherein the securing means comprises mating patches of hook-and-loop material, wherein a first patch is attached to the inside surface of the closure flap at its second end and a mating second patch is attached to the outside surface of the top panel.

4. The protective sleeve for a portable computer, as recited in claim 1, wherein a panel adjacent to the open side of the box extends at least 0.1 inch beyond the right side of the portable computer.

5. The protective sleeve for a portable computer, as recited in claim 1, wherein the edge of the top panel adjacent to the open side of the box is provided with a notch therein, and wherein the notch is sufficiently wide to accommodate the closure flap therein.

6. The protective sleeve for a portable computer, as recited in claim 1, wherein a sheet of anti-slip material is secured to at least a portion of the inside surface of the closure flap.

7. The protective sleeve for a portable computer, as recited in claim 1, wherein the location at which the closure flap is permanently attached to the bottom panel is situated at least 20 percent of the distance from the open side of the box to the side panel of the box.

8. The protective sleeve for a portable computer, as recited in claim 1, wherein the width of the closure flap is at least 25 percent of the overall width of the protective sleeve.

9. The protective sleeve for a portable computer, as recited in claim 1, wherein two adjacent panels are provided with flanges, and wherein said panels are joined to each other by sewing.

10. The protective sleeve for a portable computer, as recited in claim 1, wherein the top panel, front panel, back panel and side panel are fabricated as a single integrated top shell.

11. The protective sleeve for a portable computer, as recited in claim 10, wherein the top shell is fabricated by thermoforming a flat panel of semi-rigid material.

12. The protective sleeve for a portable computer, as recited in claim 10, wherein the edge of the top panel portion of the top shell adjacent to the open side of the box is provided with a notch therein, and wherein the notch is sufficiently wide to accommodate the closure flap therein.

13. The protective sleeve for a portable computer, as recited in claim 1, wherein a plurality of D-rings is secured to the outside surface of the bottom panel, proximate to the open side of the box.

14. The protective sleeve for a portable computer, as recited in claim 13, wherein the protective sleeve additionally comprises a handle, the handle comprising separable means for attachment to the D-rings.

15. The protective sleeve for a portable computer, as recited in claim 13, wherein the protective sleeve additionally comprises a shoulder strap, the shoulder strap comprising separable means for attachment to the D-rings.

16. A combination of the protective sleeve for a computer, as recited in claim 1, and a portable computer disposed therein, wherein the closure flap of the protective sleeve is disposed in a closed position.

17. A further combination of a larger piece of luggage, and the combination recited in claim 16 disposed therein.

18. The further combination, as recited in claim 17, wherein the larger piece of luggage comprises a suitcase.

19. The further combination, as recited in claim 17, wherein the larger piece of luggage comprises a backpack.

* * * * *